US011523961B1

(12) United States Patent
Welter et al.

(10) Patent No.: US 11,523,961 B1
(45) Date of Patent: Dec. 13, 2022

(54) SYSTEM, DEVICE AND METHOD FOR STABLE AIRWAY MANAGEMENT

(71) Applicant: Stable Airway Management, LLC, Richmond, VA (US)

(72) Inventors: William L. Welter, Richmond, VA (US); Vishal Yajnik, Richmond, VA (US); David Joshua Cohen, Richmond, VA (US)

(73) Assignee: Stable Airway Management, LLC, Richmond, VA (US)

( * ) Notice: Subject to any disclaimer, the term of this patent is extended or adjusted under 35 U.S.C. 154(b) by 0 days.

(21) Appl. No.: 17/842,141

(22) Filed: Jun. 16, 2022

Related U.S. Application Data

(60) Provisional application No. 63/251,101, filed on Oct. 1, 2021.

(51) Int. Cl.
*A61G 13/12* (2006.01)

(52) U.S. Cl.
CPC ..... *A61G 13/1215* (2013.01); *A61G 13/129* (2013.01); *A61G 2200/327* (2013.01)

(58) Field of Classification Search
CPC ..... A61G 13/1215; A61G 13/121; A61G 13/129; A61G 2200/327; A61G 13/12
See application file for complete search history.

(56) References Cited

U.S. PATENT DOCUMENTS

2010/0062391 A1* 3/2010 King ..... A61G 13/121 433/140
2011/0036355 A1* 2/2011 Farnum ..... A61G 13/1215 128/845

* cited by examiner

*Primary Examiner* — Fredrick C Conley
(74) *Attorney, Agent, or Firm* — Williams Mullen; Thomas F. Bergert

(57) ABSTRACT

Embodiments of a device facilitate controlled positioning and manipulation of an individual's relative head, neck and jaw positions to facilitate stable airway management. In various embodiments, the device includes a base to which support arms are movably attached. A thrust arm is movably attached to each support arm and a jaw disc is attached to each thrust arm and adapted for rotation in accommodating various shapes and sizes of patient jaws.

20 Claims, 8 Drawing Sheets

Fig. 4
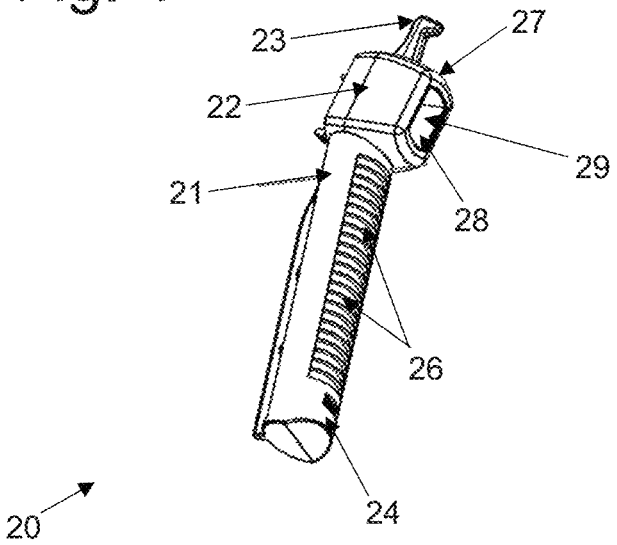
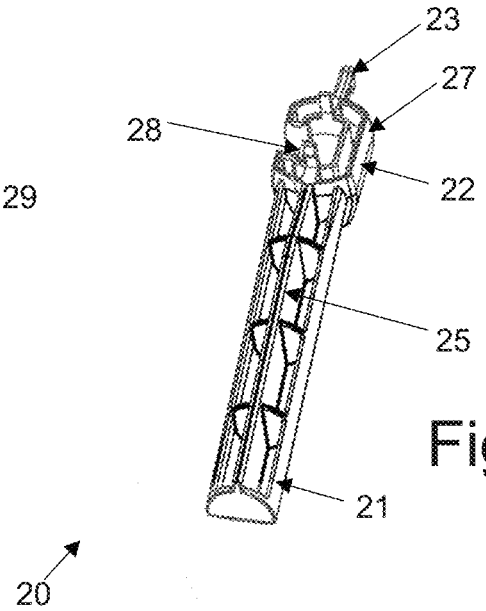
Fig. 5
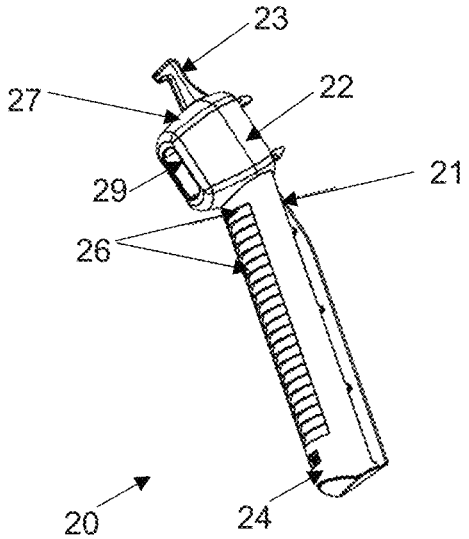
Fig. 6
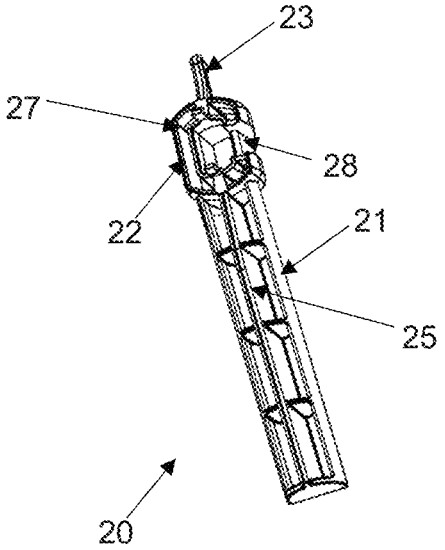
Fig. 7

Fig. 8
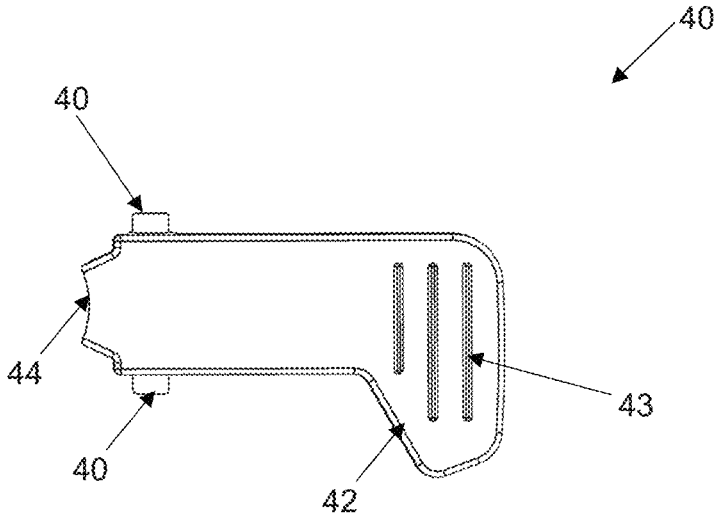
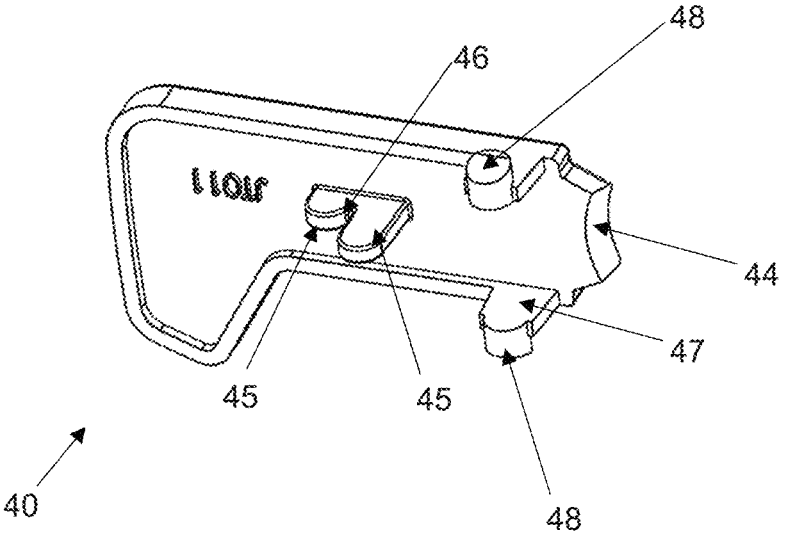
Fig. 9

Fig. 10
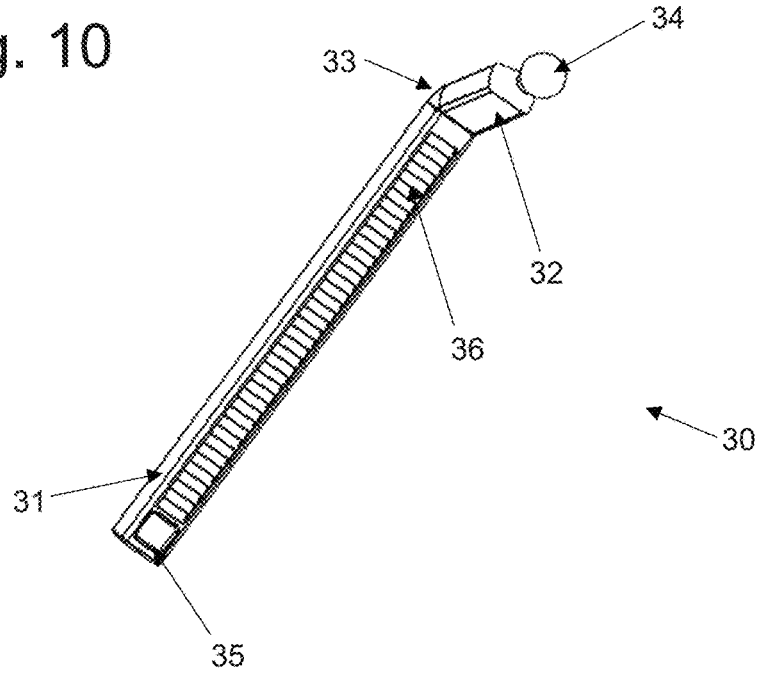
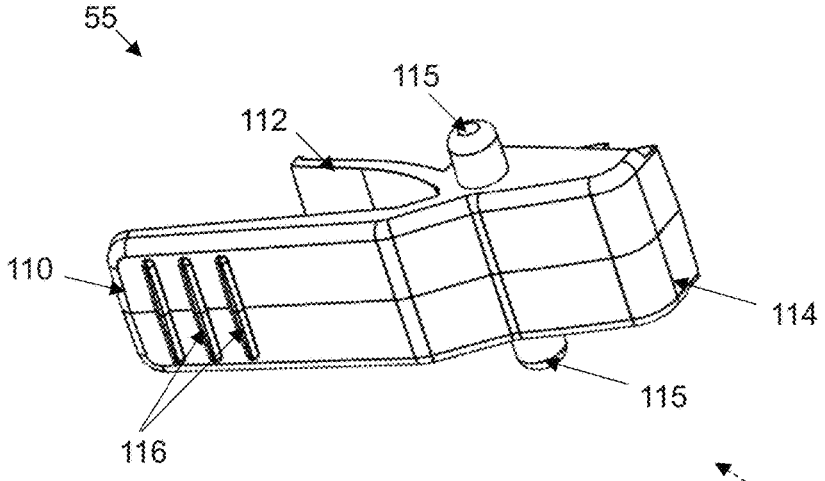
Fig. 11
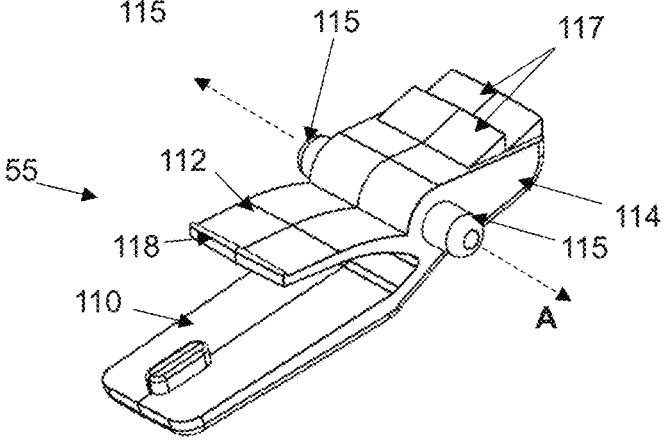
Fig. 12

Fig. 13
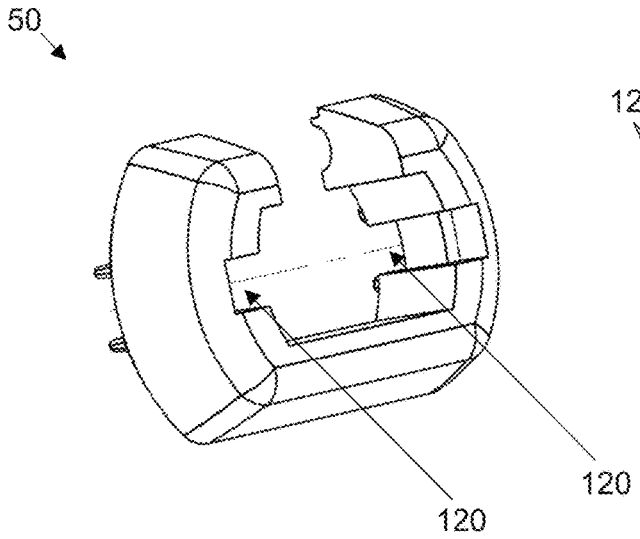
Fig. 14
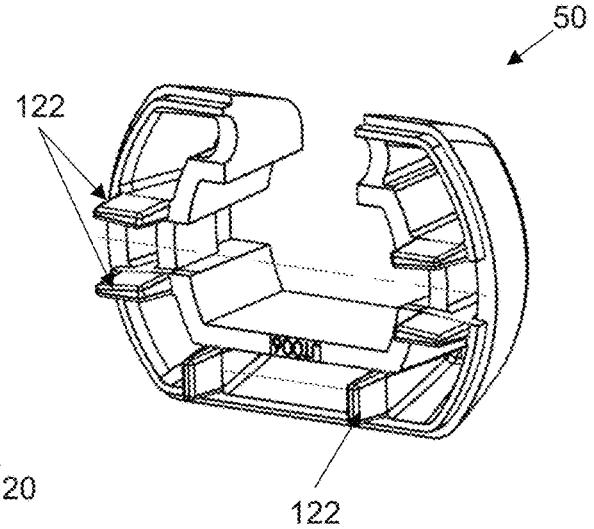
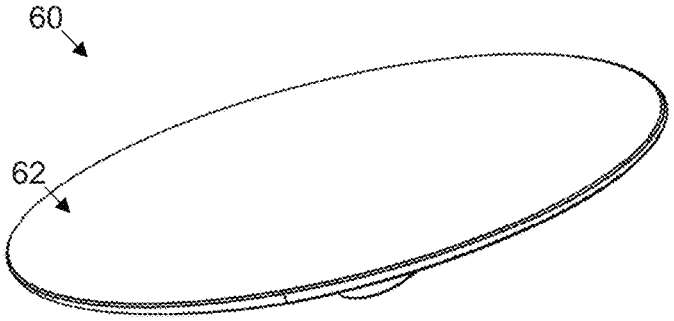
Fig. 15
Fig. 16
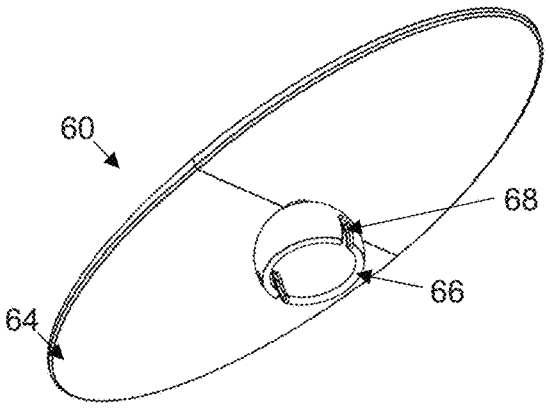

SYSTEM, DEVICE AND METHOD FOR STABLE AIRWAY MANAGEMENT

CROSS-REFERENCE TO RELATED APPLICATIONS

The present application claims priority to U.S. Provisional Patent Application No. 63/251,101 filed on Oct. 1, 2021, entitled "System, Device and Method for Stable Airway Management".

TECHNICAL FIELD

The present disclosure relates to medical devices and procedures, and more particularly to a system, device and method for facilitating stable airway management for patients.

BACKGROUND

Individuals including medical patients may encounter breathing airway blockages for various reasons. In some cases, a blockage can be caused by the backward movement of the lower jaw relative to the rest of the individual's skull, whereby the individual's tongue may block the entrance to the trachea.

Different devices and techniques have been used in the past to help rectify blocked airway passages with limited success. For example, a jaw thrust maneuver involves the attending individual placing his or her palms on the patient's temples and fingers under the patient's mandibular rami. The fingers then left the mandible upward until the lower incisors are higher than the upper incisors. This maneuver lifts the tongue with the mandible in order to relieve upper airway obstruction. Another maneuver, called the head tilt-chin lift maneuver, is performed by tilting the head backwards in unconscious patients, often by applying pressure to the forehead and the chin. The head-tilt with chin-lift maneuver can be used with patients in whom cervical spine injury is not a concern as a way of clearing an airway.

SUMMARY

Embodiments of the device, system and method according to the present disclosure facilitate controlled positioning and manipulation of an individual's relative head, neck and jaw positions to facilitate stable airway management. In various embodiments, the device of the present disclosure includes a base to which support arms are movably attached. A thrust arm is movably attached to each support arm and a jaw disc is attached to each thrust arm and adapted for rotation in accommodating various shapes and sizes of patient jaws. Components such as support arm latches and thrust arm releases facilitate controlled movement of the support arms and thrust arms. In various embodiments, the jaw disc is elliptical in shape to provide distributed support along the individual's jaw line. According to the present disclosure, an individual's chin can be lifted and supported and the individual's head can be tilted and supported akin to a head tilt-chin lift maneuver so as to facilitate open and stable airway passages.

Other aspects, features, and attendant advantages of the present disclosure will become apparent to those skilled in the art from a reading of the following detailed description of embodiments constructed in accordance therewith, taken in conjunction with the accompanying drawings.

BRIEF DESCRIPTIONS OF THE DRAWINGS

FIGS. 4 and 5 are front and rear perspective views, respectively, of a left support arm in accordance with embodiments of the present disclosure.

FIGS. 6 and 7 are front and rear perspective views, respectively, of a right support arm in accordance with embodiments of the present disclosure.

FIG. 8 is a front view and FIG. 9 is a rear perspective view, respectively, of a support arm latch in accordance with embodiments of the present disclosure.

FIG. 10 is a front perspective view of a thrust arm in accordance with embodiments of the present disclosure.

FIG. 11 is a front perspective view of a thrust arm release in accordance with embodiments of the present disclosure.

FIG. 12 is a rear perspective view of a thrust arm release in accordance with embodiments of the present disclosure.

FIG. 13 is a front perspective view of a thrust arm nose in accordance with embodiments of the present disclosure.

FIG. 14 is a rear perspective view of a thrust arm nose in accordance with embodiments of the present disclosure.

FIG. 15 is a front perspective view of a jaw disc in accordance with embodiments of the present disclosure.

FIG. 16 is a rear perspective view of a jaw disc in accordance with embodiments of the present disclosure.

DETAILED DESCRIPTION OF EMBODIMENTS

Figure 1:
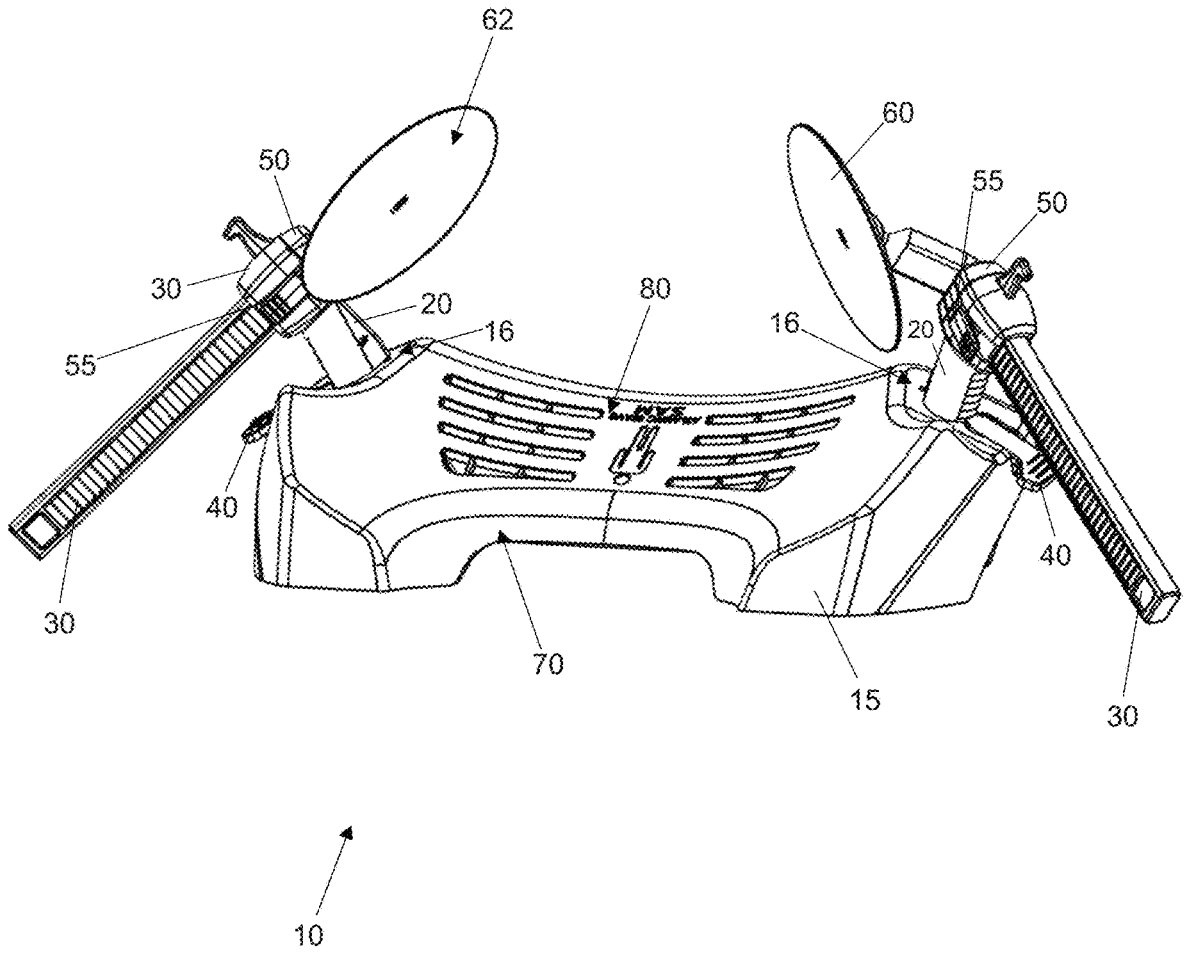
FIG. 1 is a front perspective view of a stable airway management device according to embodiments of the present disclosure.

The foregoing and other aspects of the present disclosure will now be described in more detail with respect to the description and methodologies provided herein. It should be appreciated that the disclosure can be embodied in different forms and should not be construed as limited to the embodiments set forth herein. Rather, these embodiments are provided so that this disclosure will be thorough and complete, and will fully convey the scope of the disclosure to those skilled in the art.

The terminology used in the description of the disclosure herein is for the purpose of describing particular embodiments only and is not intended to be limiting of the disclosure. As used in the description of the embodiments of the disclosure and the appended claims, the singular forms "a", "an" and "the" are intended to include the plural forms as well, unless the context clearly indicates otherwise. Also, as used herein, "and/or" refers to and encompasses any and all possible combinations of one or more of the associated listed items.

As used herein, the terms "comprise," "comprises," "comprising," "include," "includes" and "including" specify the presence of stated features, steps, operations, elements, and/or components, but do not preclude the presence or addition of one or more other features, steps, operations, elements, components, and/or groups thereof.

As shown in FIGS. 1 through 17, embodiments of the present stable airway management device 10 include a base 15, a pair of support arms 20 maintained within the base 15, a pair of thrust arms 30, each of which is movably secured to a respective support arm 20 and a pair of jaw discs 60, each of which is secured to a respective thrust arm 30. In various embodiments, the base of each thrust arm 30 connects to a respective support arm 20 via a separate thrust arm nose 50. Embodiments of the jaw discs 60 include a substantially elliptical shaped contact surface 62 that provides distributed support along the individual's jaw line when in use. It will be appreciated that pads can be provided on top of and/or around the jaw discs 60 to provide a cushion for the patient during use. Such pads may be made of Styrofoam™ or similar material, for example.

Figure 2:
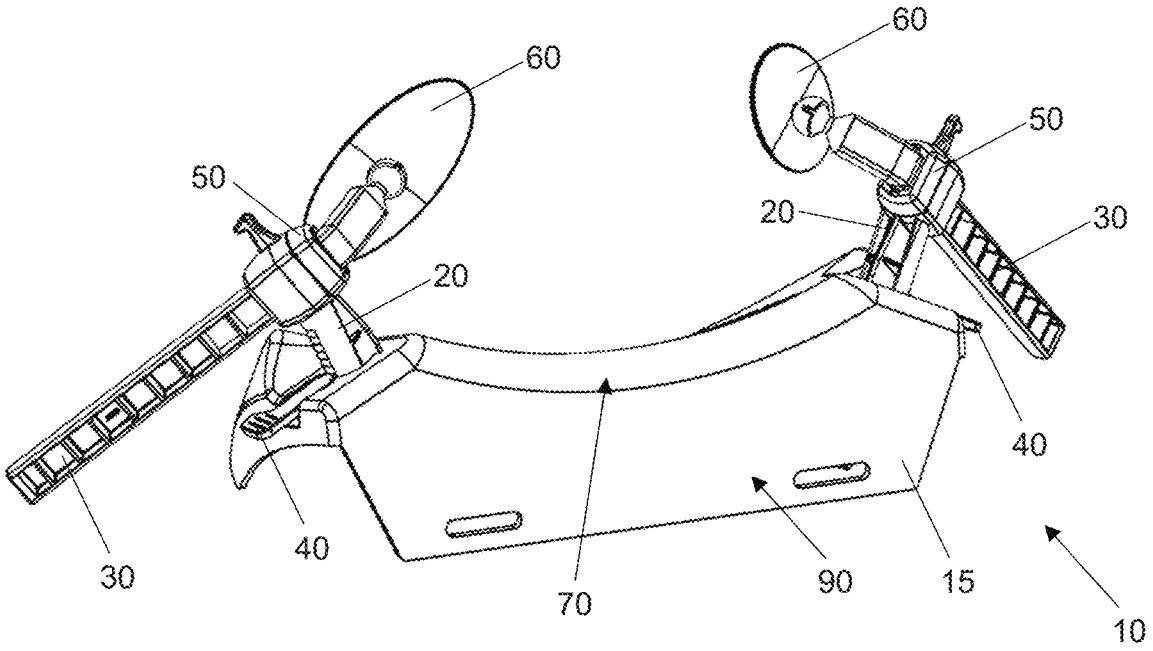
FIG. 2 is a rear perspective view of a stable airway management device according to embodiments of the present disclosure.
Figure 3:
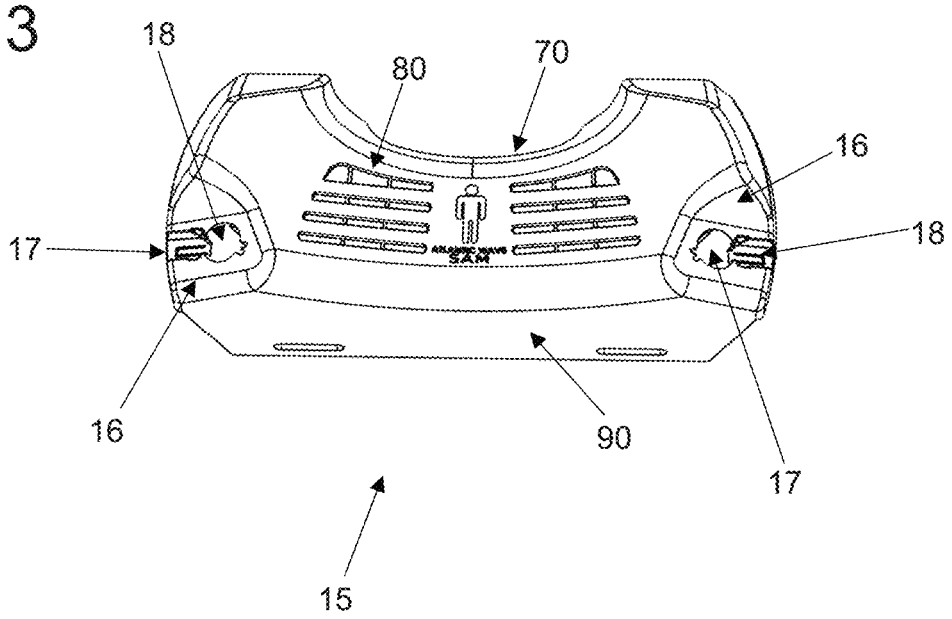
FIG. 3 is a front perspective view of a base for a stable airway management device according to embodiments of the present disclosure.

According to various embodiments, such as shown in FIGS. 1 through 3, for example, the base 15 includes a rim 70 useable as a head rest surface for a patient, a platform 80 useable as a neck rest surface for a patient and a back wall 90 which may engage a patient's shoulders during use. The base 15 can further be formed with shoulders 16, each of which has a support arm opening 17 and a latch opening 18.

In various embodiments, each support arm 20 is movably secured to the base 15. For example, as shown in FIGS. 4 through 7, each support arm 20 can be formed with a body 21, a head 22 and a head clip 23. The body 21 can be formed with a front wall 24 and an exposed wall spine 25, wherein the front wall 24 is formed with a series of ridges 26 for interacting with a support arm latch 40 as described elsewhere herein. The head 22 can be formed with an outer wall 27 and an inner wall 28 defining a head opening 29 for receiving a thrust arm 30 as described elsewhere herein. In various embodiments, the body 21, head 22 and head clip 23 are integrally formed as a monolithic unit. The body 21 of the support arm 20 can be positioned through the support arm opening 17 in the base 15 and the support arm latch 40 can further be positioned in the latch opening 18 of the base 15. The head clip 23 can be employed to pull or push the support arm 20 as needed during installation and use.

In various embodiments such as shown in FIGS. 8 and 9, for example, each support arm latch 40 is provided with an outer segment 42 formed with grip ridges 43 on a top side 41 thereof. Each support arm latch 40 can further be provided with an inner lip 44 for engaging the ridges 26 of the support arm(s) 20 as well as latch nodes 45 formed with a gap 46 therebetween for engaging a stem (not shown) on the base 15 to allow the support arm latch 40 to pivotally move about the stem. Each support arm latch 40 can further be provided with legs 47 and a prong 48 extending from each leg 47, wherein the prongs 48 are insertable into receiving areas (not shown) within the base 15 in order to retain the support arm latches 40 therein. During operation, a user can depress the support arm latch 40 such as by pressing a thumb or finger on the grip ridges 43 in order to promote contact between the inner lip 44 of the support arm latch 40 and a ridge 26 on the support arm 20, thereby pushing the support arm 20 upward in incremental distances until the desired extension of the support arm 20 from the base 15 is obtained. Alternatively, the support arm latch 40 can be depressed so as to release any resistance provided by inner lip 44 on a support arm 20, and when the support arm 20 is moved to its desired location, the support arm latch 40 is released so as to permit the inner lip 44 to engage a desired one of the ridges 26 on a support arm. Each support arm latch 40 is thus in communication with a respective support arm 20 and permits adjustment of the extension of a respective support arm 20 from a respective shoulder 16 of the base 15.

As shown in FIGS. 10 through 12, each thrust arm 30 is formed with a main body 31 and an arm extension 32 that extends from an elbow portion 33 at an angle to the axis of the main body 31. A thrust arm knob 34 extends outwardly from the arm extension 32. The main body 31 includes an inside face 35, which can be formed with various steps 36 to permit engagement with a thrust arm release 55 for permitting or restricting movement of the main body 31 of the thrust arm 30 within a respective support arm 20 as described herein. Each thrust arm release 55 can be formed with a front leg 110, a back leg 112, a latching body segment 114 and pivot nodes 115. The pivot nodes 115 can be secured within receiving elements (not shown) of the base and permit the thrust arm release 55 to rotate about an axis A as shown in FIG. 12. The front leg 110 can be formed with gripping ledges 116 for providing frictional surfaces for assisting a user when manipulating the thrust arm release 55. The back leg 112 can be formed with a leg extension 118 that can engage the inner surface of a support arm 20 such that, when a user depresses the front leg 110, the leg extension 118 engages the support arm 20 and the legs 110, 112 can flex so as to permit the latching body segment 114 to pivot about axis A and lift latching notches 117 away from the steps 36 of the inside face 35 of the corresponding thrust arm 30. In this way, a user can move the thrust arm 30 within the opening 29 of the support arm 20 and when the thrust arm 30 reaches its desired location, the user can release the thrust arm release 55 so that the latching notches 117 engage steps 36 on the thrust arm 30 and maintain the thrust arm 30 in place.

As shown in FIGS. 13 and 14, each thrust arm nose 50 is formed with slats 122 and slots 120 for facilitating connection to the support arms 20. As shown in FIGS. 15 and 16, each jaw disc 60 can be formed in a somewhat elliptical shape with a top contact surface 62 and a bottom surface 64. A clasp 66 can be formed with slots 68 to permit flexing of the clasp 66, which can be snapped into place on the thrust arm knob 34 of the thrust arm 30 during assembly and can further be rotated about the thrust arm knob 34 due to the spherical thrust arm knob 34 and the rounded clasp 66. It will be appreciated that the size of the jaw disc 60 can limit the rotational movement of the jaw disc 60 to the degree that the bottom surface 64 may contact a thrust arm 30 during movement.

Figure 17:
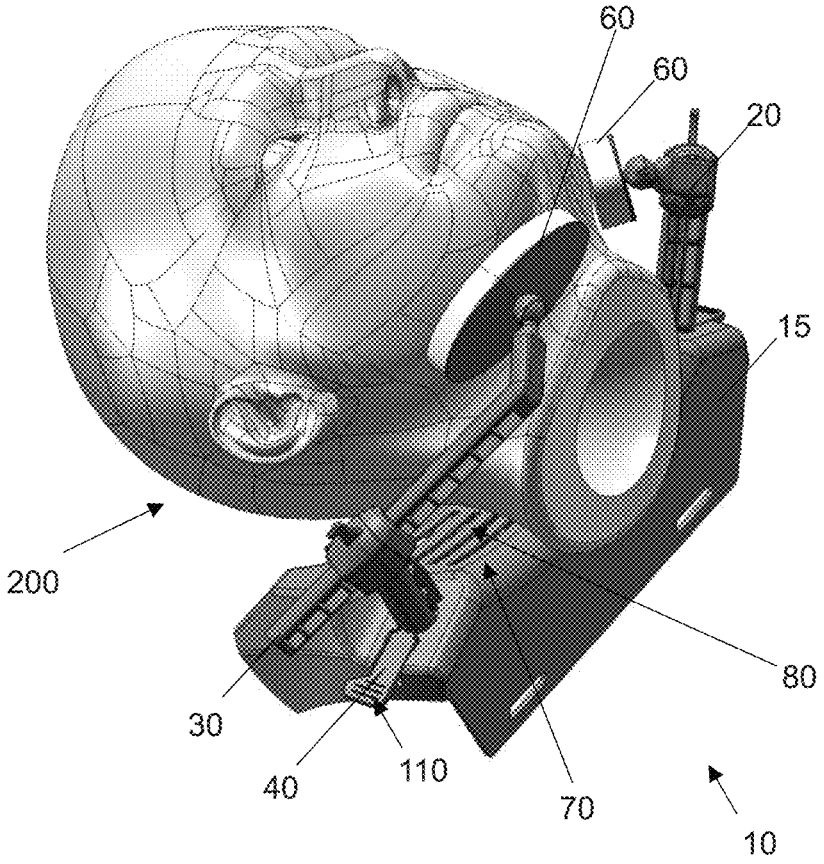
FIG. 17 is a perspective view of an implementation of the stable airway management device in accordance with aspects of the present disclosure.

FIG. 17 illustrates an implementation of the stable airway management device 10 according to embodiments of the present disclosure. As shown therein, the patient's head 200 can be positioned such that the neck lies on rim 70 of the base 15 and the head 200 rests on the platform 80 of the base 15. Pressing one of the latches 40 permits the corresponding support arm 20 to be raised or lowered and pressing the front leg 110 of one of the thrust arm release elements 55 permits the corresponding thrust arm 30 to be raised or lowered. By manipulating the support arm(s) 20 and/or thrust arm(s) 30, the jaw discs 60 can be appropriately positioned under the patient's jaw for proper and stable management of the patient's airway. The patient's chin can be lifted and held in place and the patient's head can be tilted and held in place.

Figure 18:
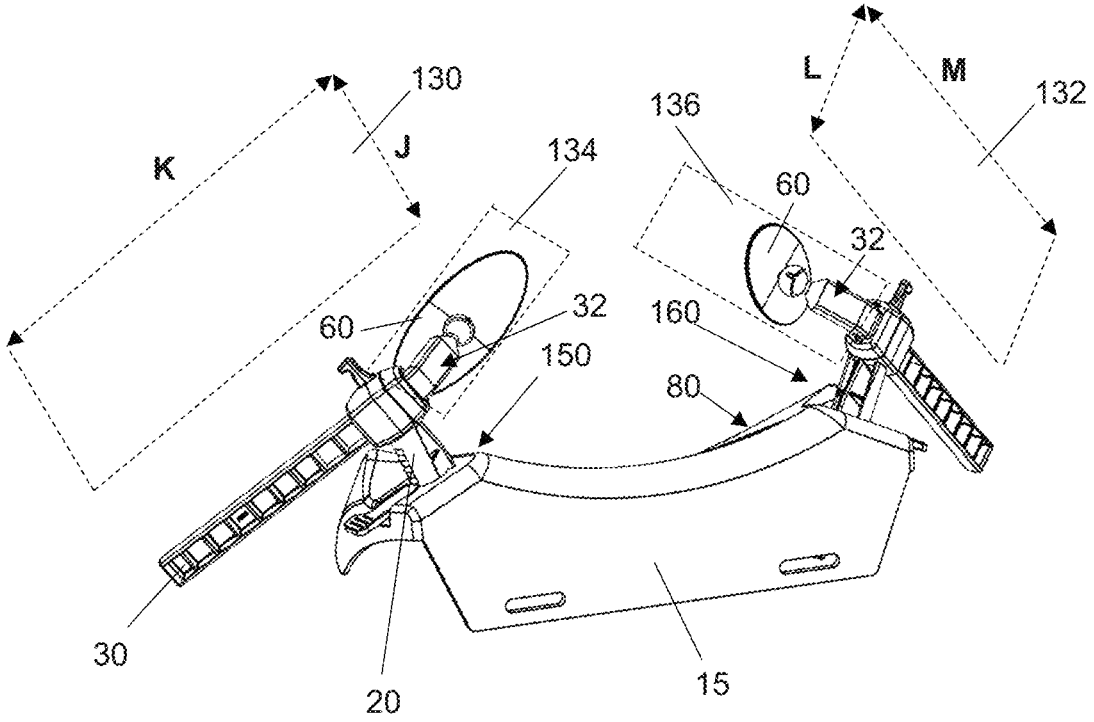
FIG. 18 is a rear perspective view of a stable airway management device according to embodiments of the present disclosure.

As shown in FIG. 18, the platform 80 of the base 15 includes a first side 150 and a second side 160, where one of the jaw discs 60 is secured to the first side 150 of the platform 80 and another of the jaw discs 60 is secured to the second side 160 of the platform 80. The jaw disc 60 on the first side 150 is secured so as to be liftable and lowerable in a first direction J along a first plane 130 relative to the platform 80 and further so as to be liftable and lowerable in a second direction K along the first plane 130. The jaw disc on the second side 160 of the platform 80 is liftable and lowerable in a third direction L along a second plane 132 relative to the platform 80 and further so as to be liftable and lowerable in a fourth direction M along the second plane 132.

As further shown in FIG. 18, the first plane 130 is not co-planar with the second plane 132, which facilitates the device properly engaging a patient during operation of the device. In various embodiments, the thrust arm extension 32 of the thrust arm 30 on the first side 150 is secured to the jaw disc 60 on the first side 150 and extends in a third plane 134 that is not co-planar with the first 130 or second 132 planes. Further, the thrust arm extension 32 of the thrust arm 30 on the second side 160 is secured to the jaw disc 60 on the second side 160 and extends in a fourth plane 136 that is not co-planar with the first 130 or second 132 planes. This arrangement also facilitates the device properly engaging a patient during operation of the device. As further shown in FIG. 18, the fourth plane 136 is not co-planar with the third plane 134. Through the non-coplanar arrangement, the raising and lowering of the jaw discs 60 permits proper alignment with a patient's head during use and proper spacing to permit removal of the patient's head from the device when not in use.

In various embodiments, all elements of the device as described herein are manufactured from materials (e.g., plastic) other than metal. In this way, the device as described herein will not affect other instrumentation such as magnetic resonance imaging (MRI) devices. The device as described herein can be manufactured via additive manufacturing (i.e., 3D printing) techniques according to various embodiments.

Although the present approach has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present approach.

The invention claimed is:

1. A stable airway management device, comprising:

a base;

first and second support arms maintained within the base;

first and second jaw discs;

first and second thrust arms, wherein the first thrust arm is movably secured to the first support arm, wherein the first jaw disc is movably secured to the first thrust arm, wherein the second thrust arm is movably secured to the second support arm, and wherein the second jaw disc is movably secured to the second thrust arm; and a first support arm latch positioned in an opening in the base, wherein the first support arm latch comprises an outer segment formed with grip ridges on a top side thereof.

2. The stable airway management device of claim 1, further comprising first and second thrust arm noses, wherein the first thrust arm comprises a base, and wherein the base of the first thrust arm connects to the first support arm via the first thrust arm nose.

3. The stable airway management device of claim 2, wherein the second thrust arm comprises a base, and wherein the base of the second thrust arm connects to the second support arm via the second thrust arm nose.

4. The stable airway management device of claim 1, wherein the base includes a rim, a platform and a back wall, and wherein each of the first and second jaw discs comprises a substantially elliptical contact surface.

5. The stable airway management device of claim 1, wherein the base comprises first and second shoulders, wherein each of the first and second shoulders comprises a support arm opening and a latch opening.

6. The stable airway management device of claim 1, wherein each of the first and second support arms is movably secured to the base.

7. The stable airway management device of claim 1, wherein each of the first and second support arms is formed with a body, a head and a head clip.

8. The stable airway management device of claim 7, wherein the body of each of the first and second support arms is formed with a front wall and an exposed wall spine, wherein the front wall is formed with a series of ridges.

9. The stable airway management device of claim 1, wherein the first support arm latch comprises a pair of legs and a prong extending from each of the pair of legs, wherein the prong is insertable into the base for retaining the first support arm latch.

10. The stable airway management device of claim 1, wherein the first support arm latch comprises an inner lip for engaging the series of ridges of the support arm.

11. The stable airway management device of claim 1, wherein the first support arm latch is formed with a plurality of latch nodes formed with a gap therebetween.

12. A stable airway management device, comprising:

a base comprising first and second shoulders, wherein each of the first and second shoulders comprises a support arm opening and a latch opening;

first and second support arms maintained within the base;

first and second jaw discs; and first and second thrust arms, wherein the first thrust arm is movably secured to the first support arm, wherein the first jaw disc is movably secured to the first thrust arm, wherein the second thrust arm is movably secured to the second support arm, and wherein the second jaw disc is movably secured to the second thrust arm.

13. A stable airway management device, comprising:

a base comprising a platform;

first and second support arms movably secured to the base;

a first thrust arm movably secured to the first support arm;

a second thrust arm movably secured to the second support arm;

a first jaw disc movably secured to the first thrust arm, wherein the first jaw disc is liftable and lowerable in a first direction along a first plane relative to the platform and liftable and lowerable in a second direction along the first plane;

a second jaw disc movably secured to the second thrust arm, wherein the second jaw disc is liftable and lowerable in a third direction along a second plane relative to the platform and liftable and lowerable in a fourth direction along the second plane.

14. The stable airway management device of claim 13, wherein the first plane is not co-planar with the second plane.

15. The stable airway management device of claim 13, wherein the first thrust arm comprises a first thrust arm main body and a first thrust arm extension, wherein the first thrust arm extension is secured to the first jaw disc and extends in a third plane that is not co-planar with the first or second planes.

16. The stable airway management device of claim 13, wherein the second thrust arm comprises a second thrust arm main body and a second thrust arm extension, wherein the second thrust arm extension is secured to the second jaw disc and extends in a fourth plane that is not co-planar with the first or second planes.

17. The stable airway management device of claim 16, wherein the fourth plane is not co-planar with the third plane.

18. The stable airway management device of claim 16, further comprising a first thrust arm knob extending outwardly from the first thrust arm extension and a second thrust arm knob extending outwardly from the second thrust arm extension, wherein the first jaw disc is secured about the first thrust arm knob and wherein the second jaw disc is secured about the second thrust arm knob.

19. The stable airway management device of claim 18, wherein the first and second jaw discs are secured about the first and second thrust arm knobs, respectively, so as to permit the first jaw disc to rotate about the first thrust arm knob and to permit the second jaw discs to rotate about the second thrust arm knob.

20. A stable airway management device, comprising:

a base;

first and second support arms maintained within the base, wherein each of the first and second support arms is formed with a body, a head and a head clip, wherein the body of each of the first and second support arms is formed with a front wall and an exposed wall spine, wherein the front wall is formed with a series of ridges;

first and second jaw discs; and first and second thrust arms, wherein the first thrust arm is movably secured to the first support arm, wherein the first jaw disc is movably secured to the first thrust arm, wherein the second thrust arm is movably secured to the second support arm, and wherein the second jaw disc is movably secured to the second thrust arm.

* * * * *